US007021563B1

(12) United States Patent
Rabitsch

(10) Patent No.: US 7,021,563 B1
(45) Date of Patent: Apr. 4, 2006

(54) SPRAY NOZZLE WITH ADJUSTABLE AND REMOVABLE DIFFUSER

(76) Inventor: Benjamin Franklin Rabitsch, P.O. Box 598, Millen, GA (US) 30442

( * ) Notice: Subject to any disclaimer, the term of this patent is extended or adjusted under 35 U.S.C. 154(b) by 0 days.

(21) Appl. No.: 10/879,354

(22) Filed: Jun. 30, 2004

(51) Int. Cl.
*B05B 1/26* (2006.01)

(52) U.S. Cl. ..... 239/505; 239/506; 239/513; 239/461

(58) Field of Classification Search ..... 239/461, 239/465, 503, 505, 507, 509, 592, 595, 524, 239/523, 522, 513, 506, 501
See application file for complete search history.

(56) References Cited

U.S. PATENT DOCUMENTS 1,639,162 A * 8/1927 Brooks ..... 239/390
3,085,754 A * 4/1963 Thompson ..... 239/523
4,277,029 A 7/1981 Rabitsch
4,648,558 A 3/1987 Rabitsch
5,076,497 A * 12/1991 Rabitsch ..... 239/310
6,866,211 B1 * 3/2005 Paulsen et al. ..... 239/597

* cited by examiner

*Primary Examiner*—David A. Scherbel
*Assistant Examiner*—Seth Barney
(74) *Attorney, Agent, or Firm*—Jacobson Holman PLLC

(57) ABSTRACT

A spray nozzle for discharging liquid in a spray pattern onto a ground surface includes a structure to obtain optimum diffusion of the liquid droplets in the spray pattern. The spray nozzle includes a diffuser plate having an upwardly extending diffuser blade thereon. The diffuser plate and blade are adjustable vertically and longitudinally in the discharge end of the nozzle to enable variation in the diffusion characteristics of the liquid discharged from the nozzle. The diffuser plate is also removable for replacement with other plates having alternative diffuser blades. The structure enables variation in the spray pattern of the liquid passing between the diffuser blade and the inner surfaces of the side walls of the nozzle by changing the location of the diffuser plate and blade in relation to the discharge end of the side walls of the nozzle or by using another plate having a different diffuser blade for different diffusion characteristics.

12 Claims, 3 Drawing Sheets

SPRAY NOZZLE WITH ADJUSTABLE AND REMOVABLE DIFFUSER

BACKGROUND OF THE INVENTION

1. Field of the Invention

The present invention generally relates to a spray nozzle for discharging liquid in a spray pattern onto a ground surface. More specifically this invention relates to improvements in the spray nozzles disclosed in my U.S. Pat. No. 4,648,558, issued Mar. 10, 1987, and U.S. Pat. No. 5,076,497, issued Dec. 31, 1991. The improved spray nozzle of this invention functions in a manner similar to the nozzles disclosed in the above mentioned patents, but includes a novel and unique structure to provide an easily adjustable diffusion of liquid in a spray pattern of liquid discharge.

2. Description of the Prior Art

The spray nozzle disclosed in FIG. 8 of my U.S. Pat. No. 4,648,558 includes a stationary diffuser blade at a discharge end of the nozzle. In my U.S. Pat. No. 5,076,497, the spray nozzle is constructed of one piece cast metal and includes a fixed diameter orifice or passageway through the nozzle of inverted, generally U-shaped configuration. The laterally spaced vertical wall surfaces of the nozzle are longitudinally parallel and a diffuser blade is secured in place therebetween at the end of the wall surfaces. A recess is formed in the top wall of the nozzle to receive the upper end of the diffuser blade and a transverse hole or holes are drilled through the top wall of the nozzle and the diffuser blade for receiving a pin or pins therethrough to secure the diffuser blade fixedly in place in the nozzle.

SUMMARY OF THE INVENTION

The spray nozzle of the present invention includes an adjustable diffuser plate and blade supported between spaced wall surfaces of an open slot at the bottom of the spray nozzle and extends upwardly into the flow path of liquid discharged from the nozzle. The diffuser blade divides the pressurized liquid passing between the side walls of the nozzle and the diffuser blade at the discharge end of the nozzle into two relatively thin columns. The columns enter an expansion zone extending from the discharge edge of the diffuser blade which entrains air into the liquid to reduce drift of liquid discharged into a spray pattern.

The diffuser plate and blade are adjustable vertically and longitudinally in the discharge end of the nozzle to enable variation in the diffusion characteristics of the liquid discharged from the nozzle. The diffuser plate and blade of this invention is also removable and can be replaced with another plate having different diffusion characteristics.

The structure of the spray nozzle includes laterally spaced, parallel longitudinal side walls interconnected by a top wall and open along at least a portion of the bottom to form a bottom slot. The slot extends over a major portion of the length of the nozzle and receives the diffuser plate to position the diffuser blade at the discharge end of the nozzle. The plate is adjustably supported both longitudinally and vertically from depending support brackets forming continuations of the side walls on opposite sides of the nozzle slot. This adjustability enables variation in the spray pattern of the liquid passing between the diffuser blade and the inner surfaces of the side walls by changing the location of the diffuser blade in relation to the discharge end of the side walls of the nozzle.

The portion of the diffuser plate supported between the depending support brackets is received in a continuation of the slot at the bottom of the side walls of the nozzle. The nozzle includes longitudinal slots in the support brackets and a vertical slot in the portion of the diffuser plate received between the support brackets. Fasteners, such as bolts, pass through the slots to secure the diffuser blade in both longitudinally and vertically adjusted relation to the flow path of the liquid discharged from the nozzle in order to cause diffusion of pressurized liquid passing between the side walls of the nozzle and the diffuser blade. The diffuser plate is also removable so that it can be interchanged with another diffuser plate having a different diffuser blade to vary the diffusion characteristics of the liquid as it is discharged into a spray pattern from the nozzle.

By adjusting the position of the diffuser blade both longitudinally and/or vertically in relation to the discharge end of the nozzle, the diffusion characteristics of the liquid discharged from the nozzle can be varied easily and quickly. This results in reduction of drift and a more consistent pattern of liquid spray and a more consistent application of a known quantity of liquid onto a known surface area to which liquid is being applied.

It is therefore an object of the present invention to provide a spray nozzle including a longitudinally and vertically adjustable diffuser blade in the discharge end of the nozzle to vary the diffusion characteristics of the liquid spray being applied to a ground surface, crops, weeds or the like.

A further object of the present invention is to provide a spray nozzle in accordance with the preceding object in which the nozzle includes a longitudinal slot in a bottom portion thereof, for receiving a diffuser plate which includes a longitudinally extending support portion forming a closure for at least a part of the slot in the bottom of the nozzle. The diffuser plate includes a diffuser blade having an upwardly extending, arcuate surface facing the pressurized liquid passing through the nozzle to cause the liquid to mix with air and enable effective diffusion of the mixture of air and liquid into a spray pattern to reduce drift of the liquid droplets after discharge from the nozzle.

Another object of the present invention is to provide a spray nozzle in accordance with the preceding objects in which the adjustment characteristics of the diffuser blade include intersecting longitudinal and vertical slots in the supporting components of the nozzle and diffuser plate with the intersecting slots receiving fasteners therethrough to enable the diffuser plate to be rigidly locked in any selected adjusted position.

A still further object of the invention is to provide a spray nozzle in accordance with the preceding objects in which the diffuser plate can be quickly and easily removed and replaced with another diffuser plate with a diffuser blade having different diffusion characteristics.

Yet another object of this invention to be specificaly enumerated herein is to provide a spray nozzle in accordance with the preceding objects which will conform to conventional forms of manufacture, be of simple construction and easy to use so as to provide a spray nozzle that will be economically feasible, strong and long lasting and relatively trouble free in installation and use.

These together with other objects and advantages which will become subsequently apparent reside in the details of constructions and operation as more fully hereinafter described and claimed, reference being had to the accompanying drawings forming a part hereof, wherein like numeral refer to like parts throughout.

BRIEF DESCRIPTION OF THE DRAWINGS

The drawings serve to illustrate the present invention, but are not intended to be drawn to scale.

DESCRIPTION OF THE PREFERRED EMBODIMENTS

Figure 1:
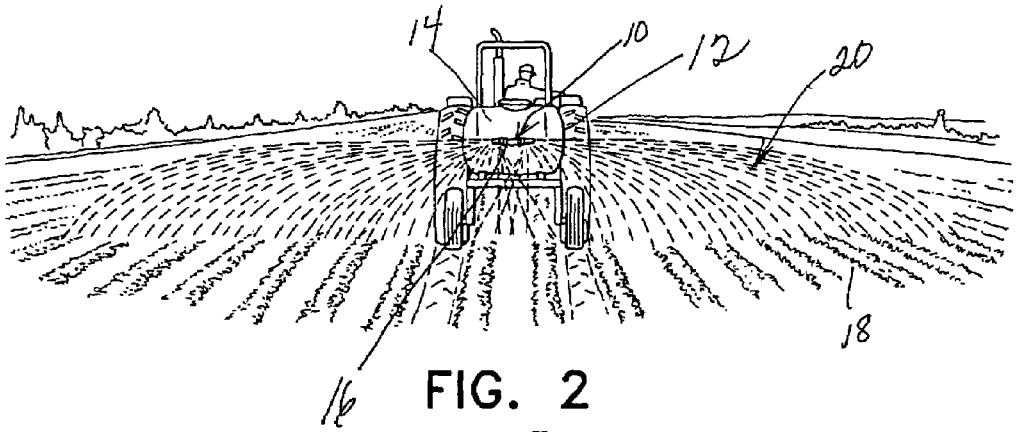
FIG. 1 is a schematic illustration of a pair of spray nozzles in accordance with the present invention communicated with a pressurized liquid supply pipe and discharging a spray pattern of diffused air and liquid to both sides of a vehicle for replacing conventional elongated booms having a plurality of longitudinally spaced nozzles thereon thereby reducing the overall lateral width of existing spray devices.

Although one preferred embodiment of the invention is explained in detail, it is to be understood that other embodiments are possible. Accordingly, it is not intended that the invention is to be limited in its scope to the details of constructions and arrangement of components set forth in the following description or illustrated in the drawings. The invention is capable of other embodiments and of being practiced or carried out in various ways. Also, in describing the preferred embodiments, specific terminology will be resorted to for the sake of clarity. It is to be understood that each specific term includes all technical equivalents which operate in a similar manner to accomplish a similar purpose.

As illustrated in FIG. 1 of the drawings, a pair of spray nozzles, constructed in accordance with the present invention, are generally designated by reference numeral 10. The nozzles 10 are utilized in combination with a vehicle such as a conventional farm tractor 12 which includes a liquid supply tank 14 with a pump connected to a supply pipe 16 for supplying pressurized liquid to the nozzles 10. The nozzles 10 apply a substantially equal volume of liquid to the ground surface 18 in a spray pattern 20 with the liquid being applied with a consistent quantity sprayed equally throughout the ground surface area.

Each spray nozzle 10 includes a one-piece generally tubular body 22 having a passageway 24 therethrough. One end of the body 22 includes external threads 26 to attach the nozzle 10 to the supply pipe 16. The body 22 includes an inwardly extending flange 28 in passageway 24 to form an orifice 30 to control the volume of liquid flowing through passageway 24. The body 22 also includes external flats 32 at the inner end of the threads 26 to enable a wrench to be used to assemble and disassemble the nozzle 10 onto the supply pipe 16.

The nozzle 10 has a discharge end 34 defined by a pair of side walls 36 connected along their top by a top wall 38. The opposed inner surfaces 40 of the side walls 36 are generally parallel and spaced apart to form a flow path in a manner generally disclosed in my above mentioned prior patents. The lower edges of side walls 36 are spaced apart to form a longitudinal slot 42 along a bottom portion of the length of side walls 36. The ends of side walls 36 are also spaced apart to form the discharge end 34.

Figure 2:
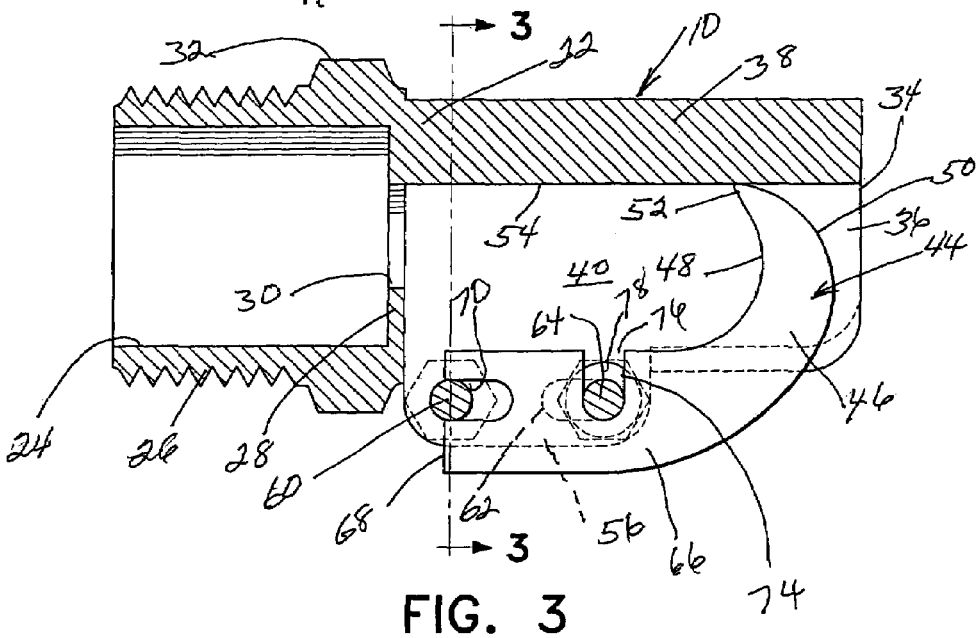
FIG. 2 is a longitudinal sectional view, on an enlarged scale, illustrating the structure of a spray nozzle in accordance with the present invention having a quickly removable and replaceable, longitudinally and vertically adjustable, diffuser plate and blade incorporated therein for variation in discharged spray patterns.

In order to diffuse the liquid flow and entrain air therein, a diffuser plate generally designated by reference numeral 44 is inserted into the open bottom slot 42 defined by the lower edges of the side walls 36 as illustrated in FIG. 2. The diffuser plate 44 includes a diffuser blade 46 having a concavely curved edge 48 facing the flow path of liquid passing through the orifice 30. The opposite edge 50 of the diffuser blade 46 is convexly curved with the juncture between the edges 48 and 50 generally defining a point 52 positioned adjacent to but in adjustable spaced relation to the underneath surface 54 of the wall 38 of body 22 as illustrated in FIG. 2. Thus, liquid flowing through the passageway 30 engages edge 48 of the diffuser blade 46 and separates into two relatively thin columns of liquid which, after passing the blade 46, recombines in an expansion zone that entrains air therein for discharge from the discharge end 34 of the nozzle 10.

Figure 3:
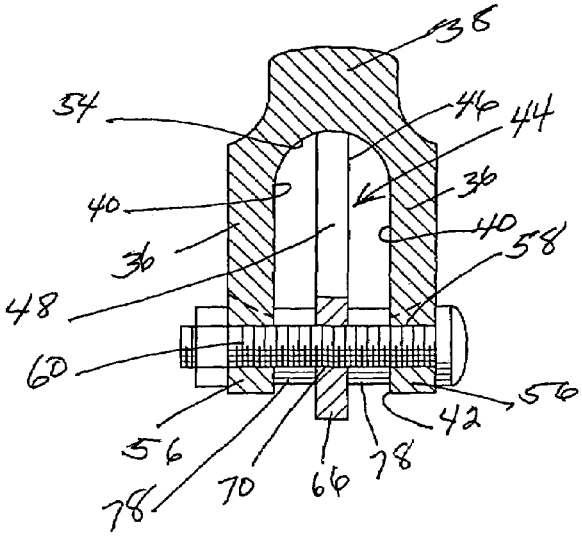
FIG. 3 is a transverse, sectional view taken along section 3—3 on FIG. 2 illustrating further structural details of the structure for supporting the diffuser blade from the nozzle body.
Figure 4:
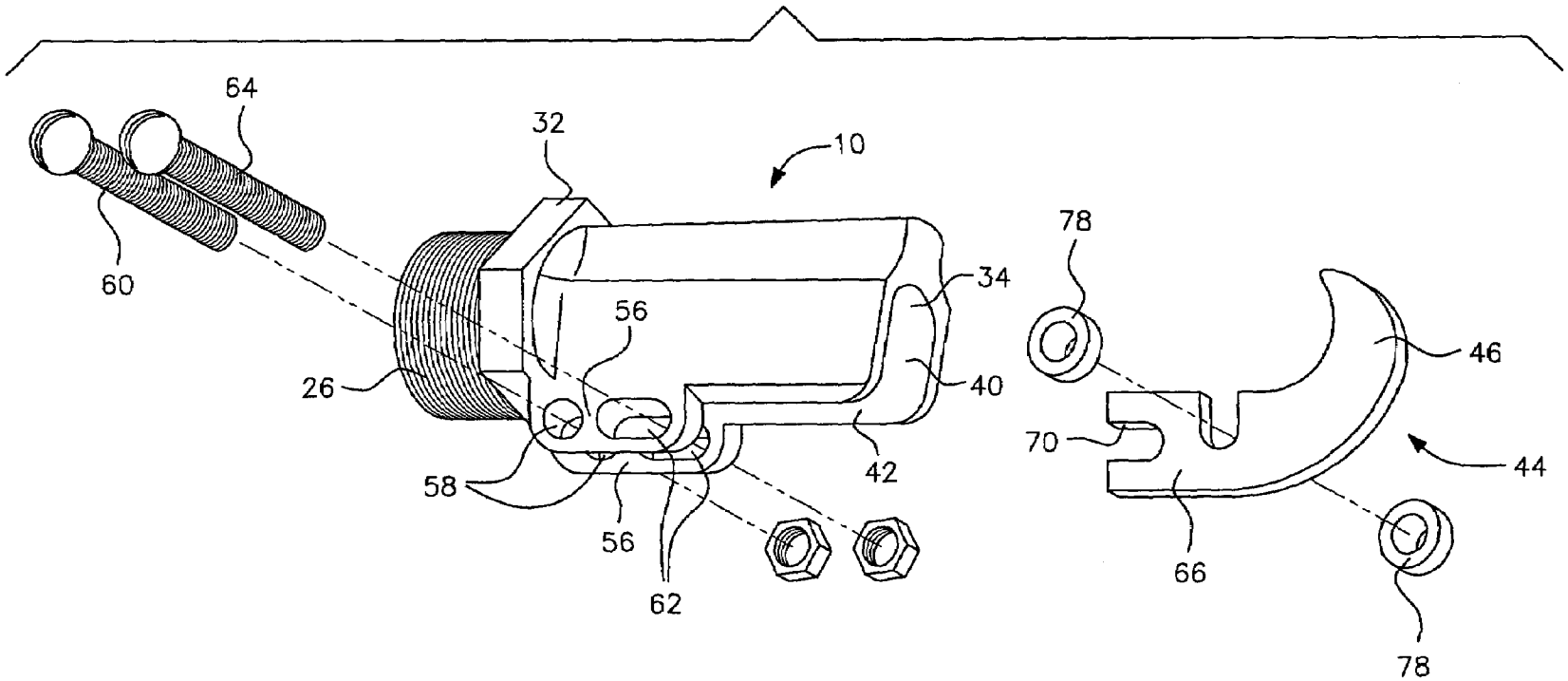
FIG. 4 is an exploded perspective view of the spray nozzle of FIG. 2.

The components of the present invention that provide the supporting connection between the diffuser plate 44 and the nozzle body 22 are important to the function on the nozzle. As shown in FIGS. 2, 3 and 4, this structure involves a pair of laterally spaced, horizontally elongated support members or brackets 56 that are of unitary construction with the lower edge of side wall 36. The brackets or members 56 extend longitudinally along and are an extension depending from the bottom edge of each side wall 36 in parallel spaced relation. Each of the brackets or members 56 includes an aperture 58 (adjacent flange 28) which receives a transverse screw threaded fastener 60 that extends through the brackets or members 56. The fastener 60 includes a head and nut to enable the fastener 60 to be secured in place.

Each of the support brackets or members 56 also includes a closed longitudinal slot 62 in alignment with and spaced from aperture 58 as illustrated in FIGS. 2 and 4. A screw threaded fastener 64 extends through the aligned slots 62 and also includes a head and nut to enable the fastener 64 to be secured in longitudinally adjusted position with respect to the support brackets or members 36.

The diffuser plate 44 includes a longitudinally extending member 66 integral with blade 46 which extends longitudinally between the longitudinal support brackets 56 and in slot 42. The member 66 has a terminal end 68 adjacent inner ends of the side walls 36 and includes a longitudinal slot 70 having an open end 72. The slot 70 straddles and receives fastener 60 therethrough and enables longitudinal adjustment of diffuser blade 44 in a manner described hereinafter. The longitudinally extending member 66 of diffuser plate 44 also includes a vertical slot 74 having an open end 76 at the upper edge of longitudinal member 66. The slot 74 intersects with slots 62 in support members 56, and fastener 64 also extends through slot 74. Spacers 78 are mounted on fastener 64 on both sides of member 66 to centralize the diffuser plate 44 and blade 46 between the support members 56 and the inner surfaces 40 of the side walls 36 as illustrated in FIGS. 2 and 3. When fastener 64 is tightened the side walls 36 can be deflected sufficiently to cause spacers 78 to frictionally lock the longitudinal member 66 in adjusted position.

Figure 5:
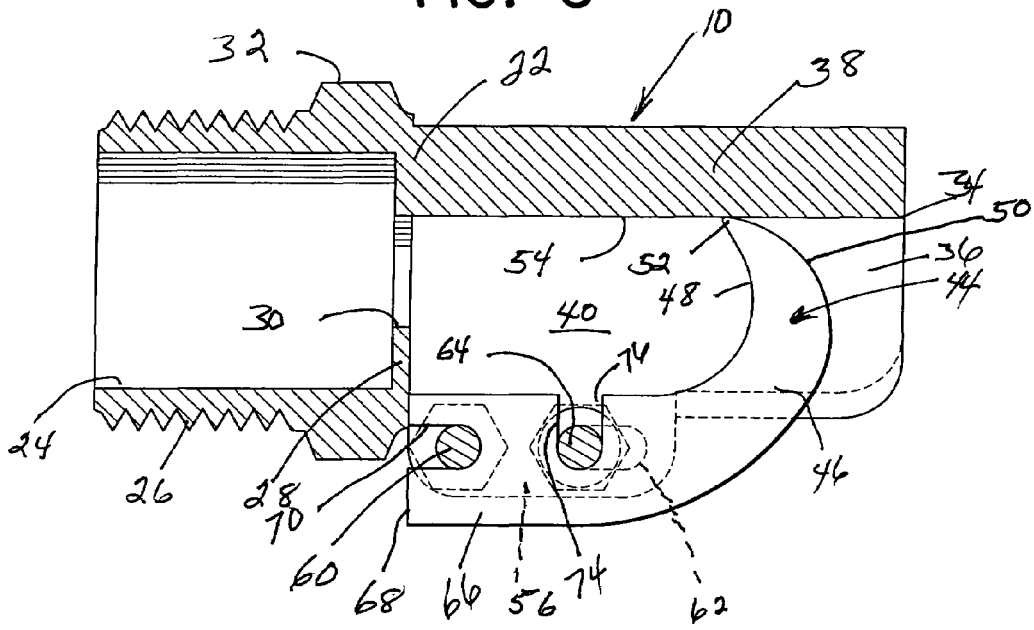
FIG. 5 is a longitudinal sectional view of the spray nozzle, similar to FIG. 2, illustrating the diffuser plate and blade adjusted longitudinally inwardly from a discharge end of the spray nozzle.
Figure 6:
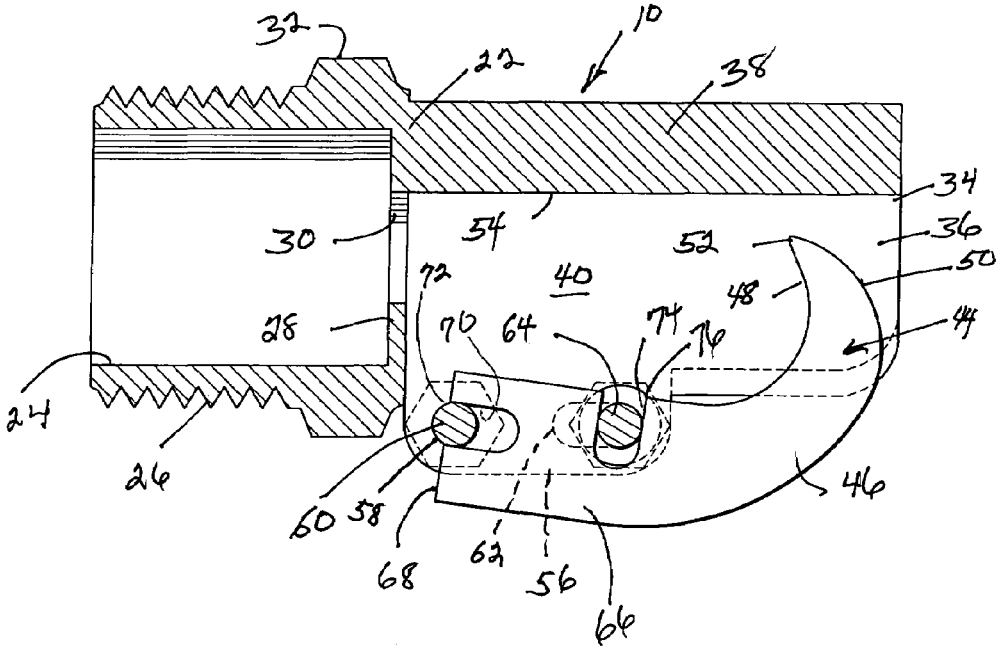
FIG. 6 is a longitudinal sectional view of the spray nozzle, similar to FIGS. 2 and 5, illustrating the diffuser plate and blade adjusted downwardly in relation to the top wall of the diffuser body.

Due to fastener 60 being slidable in slot 70 and slots 62 receiving fastener 64, loosening fasteners 60 and 64 enables the diffuser plate 44 and therefore diffuser blade 46 to be adjusted longitudinally in relation to the discharge end 34 of nozzle 10 as shown in FIG. 5. This loosening also permits the diffuser plate 44 and diffuser blade 46 to be adjusted vertically in relation to the underneath surface 54 of top wall 38 as shown in FIG. 6. Vertical adjustability occurs by slot 76 moving vertically in relation to fastener 64 and pivoting about fastener 60 with slot 70 sliding on fastener 60 to permit arcuate movement of diffuser blade 44 about an axis defined by the position of slot 70 on fastener 60 as slot 74 moves on fastener 64. The dimensional relationship between slots 70 and 74 and between fasteners 60 and 64 allows the diffuser plate 44 to be easily removed by loosening the fasteners 60 and 64 and pivoting the plate 44 downwardly about fastener 60 until fastener 64 exits slot 74 as member 66 moves longitudinally on fasteners 60 and 64. Thus, the diffuser plate 44 can be removed and replaced with another diffuser plate having a different diffuser blade to obtain different spray pattern characteristics rather than replacing the entire nozzle to obtain different spray patterns.

Due to the relationship among the slots 70, 74, and 62, the fasteners 60 and 64 and the diffuser blade 44, the diffuser blade 44 can be adjusted longitudinally in the passageway 24 and in relation to the discharge end 34 of the side walls 36 of the body 22 which form the bottom slot 42. Also, this structure enables adjustment of the diffuser plate 44 and blade 46 vertically in relation to the passageway 24 with the tip end 52 of diffuser blade 46 adjusted toward and away from the underneath surface 54 of the top wall 38.

As the pressurized liquid is divided into two thin columns as it passes the diffuser blade 46, velocity of the liquid increases so that when it passes the rearward edge 50 of the diffuser blade 46, a zone of reduced pressure will be created. This reduced pressure facilitates entrainment and mixing of air into the liquid and discharge of the air and liquid mixture into the spray pattern thereby reducing the tendency of liquid droplets to drift as they are discharged from the discharge end 34 of the nozzle 10. This structure enables variation in the diffusion characteristics of the air and liquid being discharged from the nozzles 10 in order to adjust the spray characteristics of the liquid in the spray pattern 20.

The foregoing is considered as illustrative only of the principles of the invention. Further, since numerous modifications and changes will readily occur to those skilled in the art, it is not desired to limit the invention to the exact construction and operation shown an described, and, accordingly, all suitable modifications and equivalents may be resorted to, falling within the scope of the invention.

What is claimed is:

1. A spray nozzle for attachment to a supply pipe of pressurized liquid comprising a body of tubular construction having a passageway therethrough communicating with a supply of pressurized liquid, said body including a pair of laterally spaced, generally parallel vertical side walls interconnected by a top wall and defining an open bottom slot and an open discharge end, a diffuser blade extending upwardly through the bottom slot into the passageway adjacent said discharge end and dividing liquid passing through the passageway into a pair of relatively thin columns passing between the inner surfaces of the side walls and the diffuser blade for diffusing the liquid being discharged from the discharge end of the nozzle, and fastening structure interconnecting said diffuser blade and said body for longitudinal adjustment of the diffuser blade in relation to said passageway and vertical adjustment of the diffuser blade in relation to said passageway.

2. The spray nozzle as claimed in claim 1, wherein said fastening structure includes depending support brackets extending downwardly from the side walls, slots in a supported portion of the diffuser blade, and fasteners extending through said support brackets and said slots to secure the diffuser blade in adjusted longitudinal and vertical positions in relation to the passageway and discharge end of the nozzle.

3. The spray nozzle as claimed in claim 2, wherein each of said support brackets includes a longitudinal slot, said supported portion of the diffuser blade includes a vertical slot intersecting said longitudinal slots, one of said fasteners extending through the longitudinal slots and the vertical slot at a point of intersection to secure the diffuser blade in adjusted positions.

4. The spray nozzle as claimed in claim 3, wherein said supported portion of said diffuser blade includes an open ended longitudinal slot in a terminal end thereof remote from said vertical slot, said vertical slot in said supported portion of said diffuser blade having an open upper end, said slots and fasteners being related to enable said diffuser blade to be adjusted longitudinally and locked in adjusted position, to be pivoted about the fastener extending through said open ended longitudinal slot in said supported portion of the diffuser blade and locked in adjusted position to adjust the vertical position of the diffuser blade in said passageway, and to be pivoted until the fastener in said vertical slot exits from the vertical slot in said supported portion of the diffuser blade to permit said diffuser blade to be separated from said support brackets by moving said open ended longitudinal slot in the terminal end of of said supported portion of said diffuser blade longitudinally beyond the fastener extending through said open ended longitudinal slot to enable removal and replacement of selective diffuser blades having different spray pattern patterns.

5. The spray nozzle as claimed in claim 4, wherein said diffuser blade includes a concavely curved vertical edge facing upstream of liquid passing through said passageway.

6. The spray nozzle as claimed in claim 4, wherein said diffuser blade includes an upper end adjacent said top wall, said diffuser blade including generally parallel side surfaces in spaced generally parallel relation to inner surfaces of said side walls.

7. The spray nozzle as claimed in claim 6, wherein said fasteners extending through said vertical slot in the diffuser blade includes spacers thereon spacing said diffuser blade equally from said support brackets and centrally in said passageway.

8. A spray nozzle for attachment to a supply of pressurized liquid comprising a body having a passageway communicating with a supply of pressurized liquid in which pressurized liquid passes, said body including a pair of longitudinally extending, transversely spaced side walls interconnected by a top wall and open at the bottom to define an inverted U-shaped cross-sectional configuration, said side walls including inner wall surfaces that are substantially parallel and extend to an open discharge end of said nozzle, a diffuser blade in said passageway and in spaced parallel relation to said side walls adjacent said discharge end of said nozzle to define a pair of narrow passageways for discharge of liquid in the form of a spray pattern onto a ground surface, said body supporting said diffuser blade enabling longitudinal and vertical adjustment of the diffuser blade in relation to said passageway.

9. The spray nozzle as claimed in claim 8, wherein said body is tubular and includes a threaded end to support said body from a liquid supply pipe, the interior of said body including a peripheral inwardly extending flange having a central opening forming an orifice.

10. A spray nozzle communicating with a supply of pressurized liquid, said spray nozzle comprising a body having an orifice therein controlling the rate of liquid flow therethrough, said nozzle including a pair of longitudinally extending, transversely spaced side walls interconnected by a top wall and an open slot at the bottom to define an inverted U-shaped cross-sectional configuration, said side walls including inner surfaces that are substantially vertical, said inner side wall surfaces being longitudinally parallel from said orifice to a discharge end of said nozzle, a generally vertical diffuser blade extending between and in spaced parallel relation to said side walls to define a pair of passageways for discharge of liquid into a spray pattern and adjustable structure supporting said diffuser blade from said body for adjustment of said diffuser blade longitudinally and vertically between said side walls.

11. The spray nozzle as claimed in claim 8, wherein said diffuser blade support structure includes at least one vertical slot in one of said diffuser blade and said nozzle body, at least one longitudinal slot in the other of said diffuser blade and said nozzle body, said slots being positioned in intersecting relation and a fastener extending through said slots at a point of intersection to secure said diffuser blade in vertically and longitudinally adjusted position in relation to said side walls.

12. The spray nozzle as claimed in claim 11, wherein at least one of said slots is open ended to enable exit of said fastener to remove said diffuser blade and replacement with a diffuser blade having different diffusion characteristics.

* * * * *